United States Patent [19]

Suzuki

[11] Patent Number: 4,899,692

[45] Date of Patent: Feb. 13, 1990

[54] AUTOMATIC WAX COATING APPARATUS FOR USE WITH SKIS

[75] Inventor: Choushiro Suzuki, Kunitachi, Japan

[73] Assignee: Field Corporation, Musashino, Japan

[21] Appl. No.: 322,855

[22] Filed: Mar. 14, 1989

[30] Foreign Application Priority Data

Jun. 30, 1988 [JP] Japan ..... 63-163481

[51] Int. Cl.[4] ..... B05C 11/00

[52] U.S. Cl. ..... 118/668; 118/680; 118/681; 118/58; 118/63; 118/72; 118/100; 118/110; 118/120; 118/313; 118/315

[58] Field of Search ..... 118/58, 63, 72, 100, 118/110, 113, 120, 300, 313, 315, 668, 677, 680, 70, 681

[56] References Cited

U.S. PATENT DOCUMENTS

| | | | |
|---|---|---|---|
| 2,537,511 | 1/1951 | Coulombe | 118/72 |
| 3,425,394 | 2/1969 | Rey | 118/72 |
| 4,457,255 | 7/1984 | Amann | 118/72 |
| 4,577,586 | 3/1986 | Morris et al. | 118/72 |
| 4,717,601 | 1/1988 | Bocquet | 118/72 |

*Primary Examiner*—Willard Hoag

*Attorney, Agent, or Firm*—Armstrong, Nikaido, Marmelstein, Jubovcik & Murray

[57] ABSTRACT

In an automatic wax coating apparatus for use with skis, a securing device for securing ski, a wax supplying device, a brushing device and a movement device are provided in the interior of a box for accommodating the ski strips. The brushing device comprises a hot air nozzle for blowing hot air onto the ski, a roller brush for brushing the sliding surfaces of the ski, and a wax nozzle for spraying the sliding surfaces of the ski with a wax supplied from the wax supplying device, and the brushing device can be moved along the longitudinal axes of the ski by means of the movement device.

And as occasion demands, the brushing device makes a plurality of reciprocating movements along the longitudinal axes of the ski to apply a wax coat of even more accurately controlled uniformity, thickness, surface texture and so forth.

7 Claims, 4 Drawing Sheets

AUTOMATIC WAX COATING APPARATUS FOR USE WITH SKIS

BACKGROUND OF THE INVENTION AND RELATED ART STATEMENT

The present invention relates to an automatic wax coating apparatus for use with skis and, more particularly, to an apparatus for automatically coating the sliding surfaces of ski strips with a liquid wax.

Ski contestants have heretofore manually applied a wax coating to the sliding surfaces of their skis in a series of steps performed in the following order.

(1) Snow or dirt is removed from the sliding surfaces of the ski strips and the ski strips are dried.

(2) The old wax remaining on the sliding surfaces of the ski strips is removed, as by shaving.

(3) A new coat of liquid or solid wax is applied to the sliding surfaces of the ski strips and the wax coated is dried.

(4) The uniformity, thickness and surface texture of the wax coated are checked.

(5) Any superfluous portion of the wax coated and the wax over unwanted areas is removed, as by shaving.

In addition, the practice of applying a coat of wax to reduce the friction in accordance with the quality of snow has become popular among skiers in general.

However, such skiers tend to complete the application of a wax coat in a time period which is short compared with the time which it would normally take for ski contestants to complete the application of a wax coat. For this reason, many skiers omit the above procedures (2) and (5).

Irrespective of whether ski contestants or skiers apply a wax coat, it is, of course, desirable that the uniformity, thickness, surface texture and so forth of the wax coated onto their skis be accurately controlled. Accordingly, almost all those who coat their skis with a wax have checked the quality of the coating, laying down the ski strips on a flat surface so as to immediately visually check whether the uniformity, thickness, surface texture and so forth of the coated wax are accurate.

However, the above-described manual application of a wax coat has the following problems:

(1) Since all the operations that accompany the application of a wax coat has been performed manually, several awkward problems are encountered. For example, skiers often have their hands scratched during removal of the wax or their clothes dirtied by the wax during application thereof. In addition, the skiers must manually perform, for themselves, all the operations required to apply the wax coat, and the application of the wax coat has literally been time-consuming work.

(2) In the application of a wax coat, it is possible to omit the steps of removing, as by shaving, the old wax remaining on the sliding surfaces of the ski strips and the step of removing any superfluous portion of the wax coated and the wax over unwanted areas, as by shaving. However, since it is impossible to perform a plurality of steps in parallel, it finally takes a long time to complete all the work.

(3) In almost all the cases, the application of a wax coat requires a space which allows a person to perform the application of a wax coat and the space required for the ski strips to be laid down.

It is common practice, however, that the application of a wax coat is actually performed in a place such as a home, a lodging near a skiing ground, and so forth. Accordingly, it has been difficult to provide the space required to lay down ski strips and to apply a wax coat to them.

Needless to say, it is not desirable to perform the application of a wax coat outdoors. Small dust may stick to a wet wax due to a wind and, in addition, if the atmospheric temperature is excessively low, it will take a long time for the wax to perfectly dry and the person will have to withstand coldness.

One method of effecting in a narrow indoor space is to apply a wax coat to ski strips which are leaned against something. In this method, however, it is difficult to immediately visually check whether the wax coat has been applied with accurately controlled uniformity, thickness and surface texture. Accordingly, such a method is not a desirable one for those who desire to accurately control the uniformity, thickness surface texture of the wax coated.

OBJECT AND SUMMARY OF THE INVENTION

In the light of the problems involved in the above-described manual application of a wax coat, an object of the present invention is to provide a compact apparatus of the type in which the manual operations which attend the application of a wax coat are automated.

In accordance with the present invention, there is provided an automatic wax coating apparatus for use with skis characterized in that a securing device for securing ski strips, a wax supplying device, a brushing device and a movement device are provided in the interior of a box for accommodating the ski strips, in which the brushing device comprises a hot air nozzle for blowing hot air onto the ski strips, a roller brush for brushing the sliding surfaces of the ski strips, and a wax nozzle for spraying the sliding surfaces of the ski strips with a wax supplied from the wax supplying device, whereby the brushing device can be moved along the longitudinal axes of the ski strips by means of the movement device.

In the automatic wax coating apparatus in accordance with the present invention (hereinafter referred to as the "wax coating apparatus"), two ski strips are located in the interior of the box-like body so that they can be clamped and secured by the securing device.

The securing device clamps and secures the ski strips so that the brushing device may be moved along the longitudinal axes of the ski strips which has thus been located in the box-like body.

While the brushing device is moving along the sliding surfaces of the ski strips, the brushing device blows hot air through the hot air nozzle, implementing brushing using the roller brush, and spraying from the wax nozzle the wax supplied from the wax supplying device.

As occasion demands, the brushing device makes a plurality of reciprocating movements along the longitudinal axes of the ski strips to apply a wax coat of even more accurately controlled uniformity, thickness, surface texture and so forth.

In accordance with the present invention, wax coating which has heretofore required manual operation is automated by providing the automatic wax coating apparatus for use with skis, and the following advantages can be provided.

(1) The required manual operation consists merely of placing ski strips into and removing them from the wax coating apparatus according to the present embodiment. Accordingly, the number of manual operations can be greatly reduced and, additionally, a wax coating of accurately controlled uniformity, thickness, and surface texture can be applied by automation.

(2) Since the hot air nozzle is incorporated into the brushing device, the step of melting snow stuck to the ski strips and drying them as well as the step of drying the wax coated with hot air can be efficiently achieved. Accordingly, the required working time can be reduced.

(3) Applying of a coat of wax is enabled only if there is a space which can accommodate the wax coating apparatus according to the present invention. Accordingly, the working space required to apply the wax coat can be reduced.

DETAILED DESCRIPTION OF PREFERRED EMBODIMENT

Figure 1:
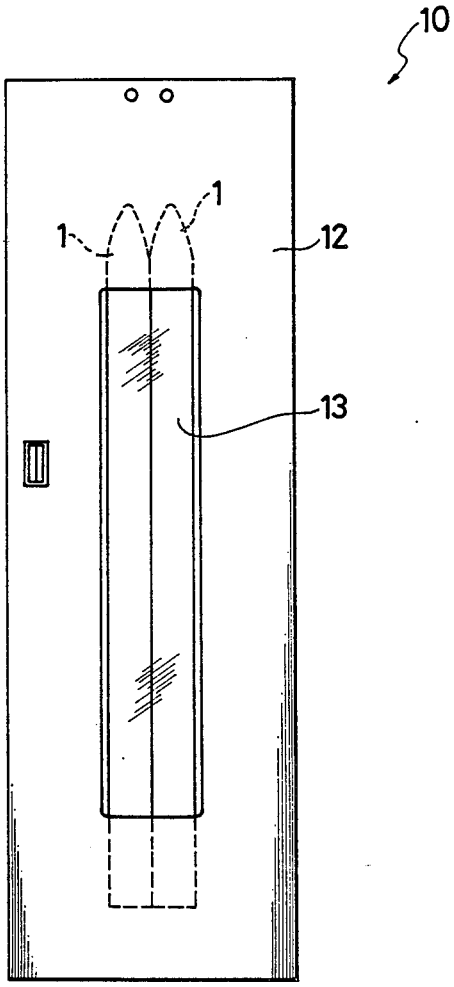
FIG. 1 is a front view showing an embodiment of the present invention.
Figure 2:
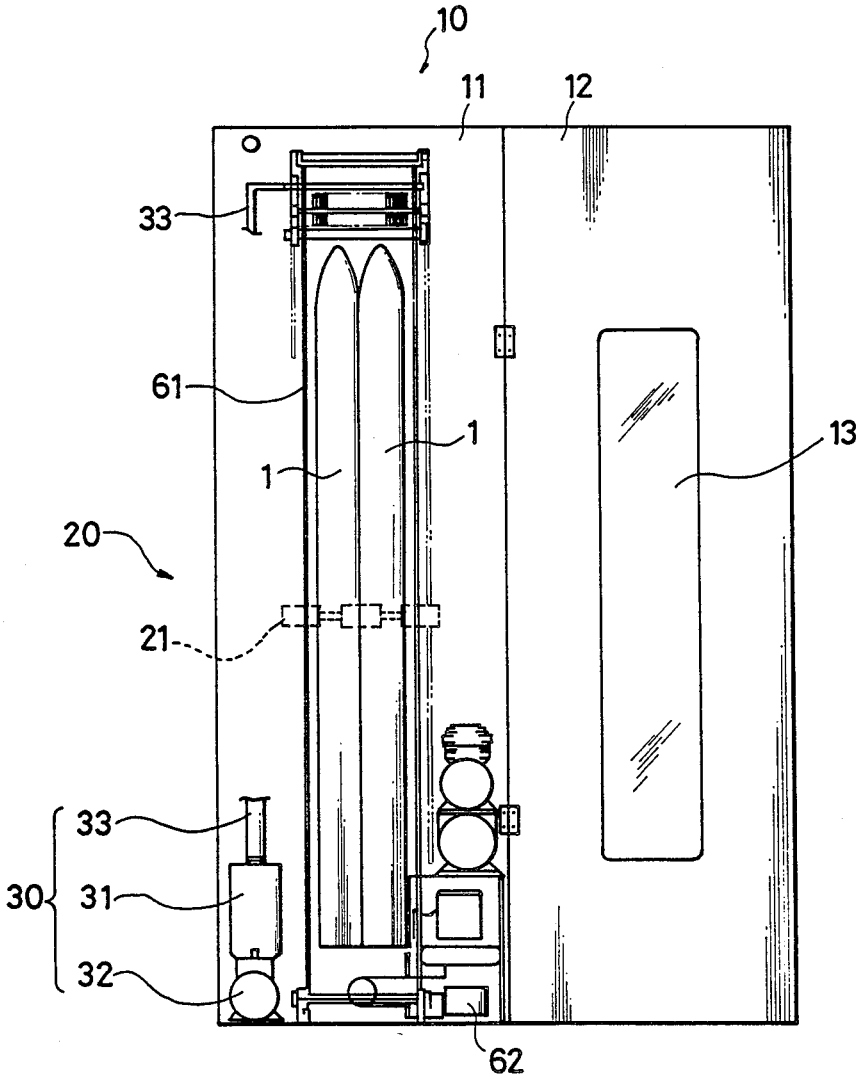
FIG. 2 is a front view showing the essential portion of the embodiment of the present invention with a swingable door open.
Figure 3:
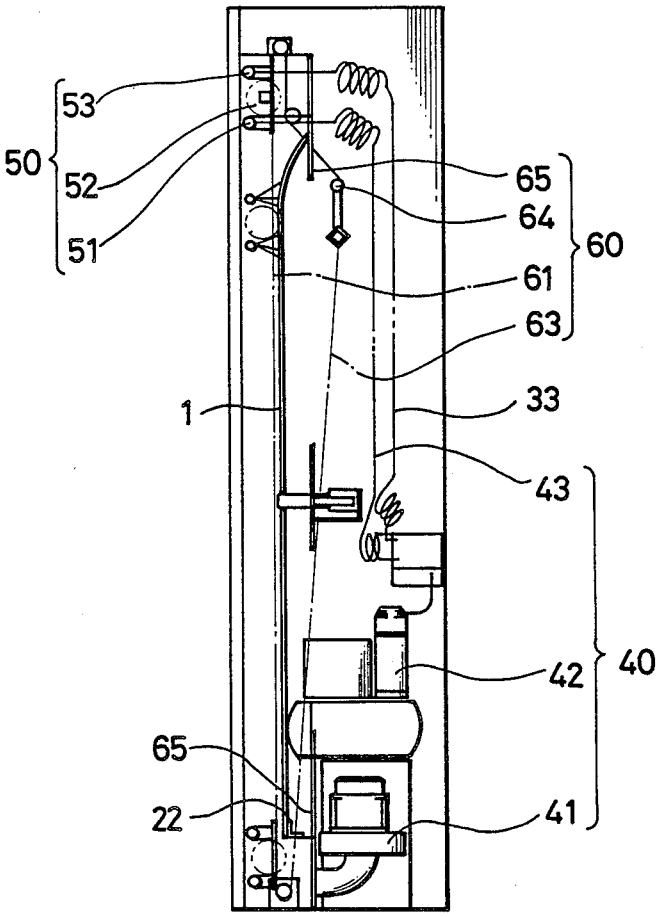
FIG. 3 is a side view showing the essential portion of the embodiment invention with a front side plate removed.

The present invention will be described hereinbelow in greater detail with reference to FIGS. 1–4 which show an embodiment of the present invention.

An automatic wax coating apparatus 10 for use with skis (hereinafter referred to as the "wax coating apparatus 10") is constituted by a box-like body 11 in the form of a rectangular parallelepiped in which two ski strips 1 can be disposed vertically and side-by-side. The body 11 includes a securing device 20 for clamping and securing the ski strips 1 that are thus vertically accommodated, a wax supplying device 30 for both storing a wax and supplying it, a compressed-air supplying device 40 for generating compressed air and supplying it, a brushing device 50 for effecting spraying of a wax, brushing and so forth, and a movement device 60 for causing the brushing device 50 to move along the longitudinal axes of the ski strips 1.

(1) The body 11 has a swingable door 12 serving as a front plate which can be freely opened and closed, and a transparent front glass window 13 is mounted near the center of the swingable door 12 so as to allow observation of the interior of the body 11.

Figure 4:
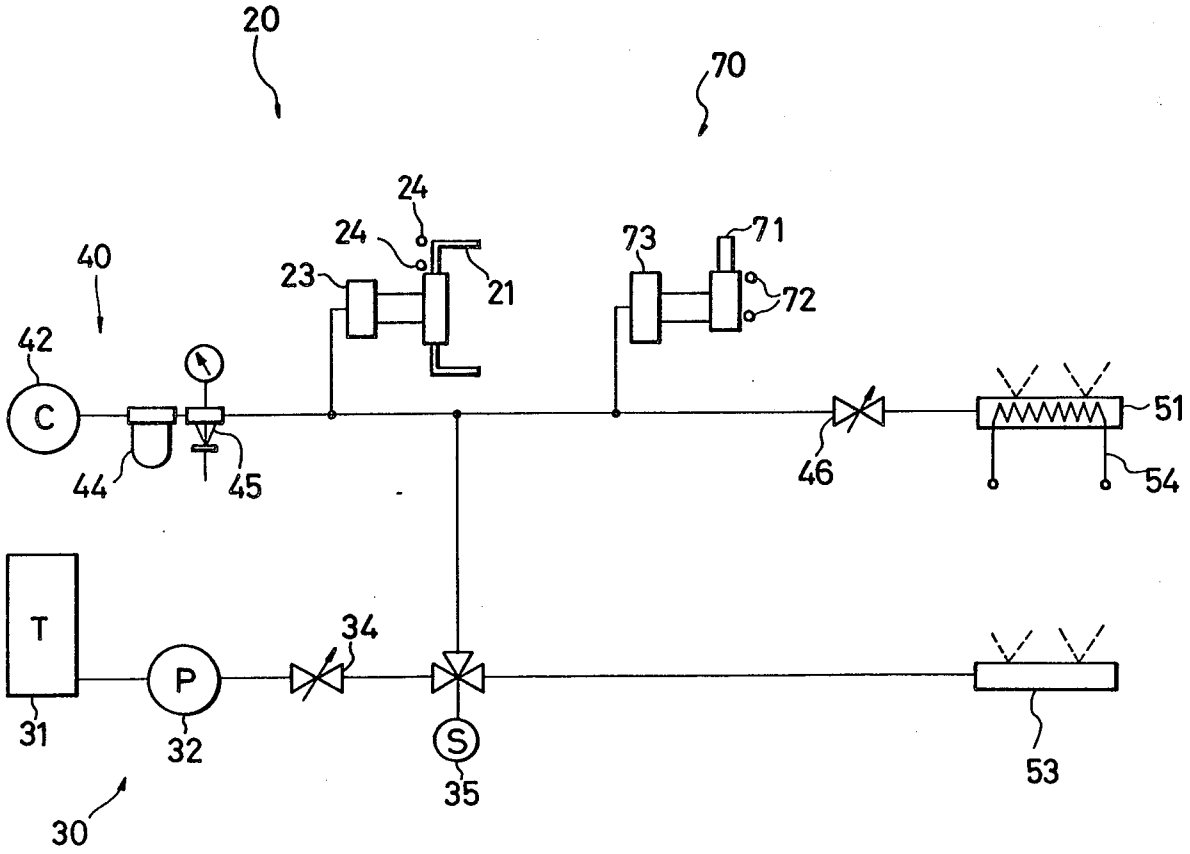
FIG. 4 is a schematic illustration showing the essential parts used in the embodiment of the present invention.

A door lock 70 is provided on a portion of the interior of the body 11 of the wax coating apparatus 10 according to the present embodiment (refer to FIG. 4). The door lock 70 serves to prevent the swingable door 12 from opening during operation of the wax coating apparatus 10, thereby preventing a wax being ejected from the wax coating apparatus 10. The door lock 70 is constituted by a door-lock air cylinder 71, a door-lock checking sensor 72 and a door-lock solenoid valve 73.

The door-lock air cylinder 71 serves to lock or unlock the swingable door 12 by means of the compressed air supplied from the compressed-air supplying device 40.

The door-lock checking sensor 72 is a sensor which serves to detect whether or not the swingable door 12 is locked. If the swingable door 12 is not correctly locked, the door-lock checking sensor issues a command to restrain the brushing device 50 from operating.

The door-lock solenoid valve 73 is a solenoid valve which provides ON-OFF control to determine whether or not compressed air required as power should be supplied when the door-lock air cylinder 71 is to lock or unlock the swingable door 12.

Although not shown, a coin slot is provided in the outer surface of the swingable door 12.

(2) The securing device 20 serves to secure two ski strips 1 which are vertically disposed in the inner space of the body 11 with their respective sliding surfaces arranged in the same plane so as to enable the brushing device 50 to perform its function correctly. The securing device 20 is constituted by a clamper 21, a clamper checking sensor 24 (FIG. 4) and a clamper solenoid valve 23 (FIG. 4).

A strip holder 22 is provided on the bottom of the interior of the body 11 for securing the lower ends of the respective ski strips 1 when the ski strips 1 are secured by the securing device 20.

The clamper 21 serves to clamp and secure the two ski strips 1 by using, as power, the compressed air supplied from the compressed-air supplying device 40. The clamper 21 is disposed near the center of the inner space of the body 11.

The clamper checking sensor 24 is a sensor for detecting whether the two ski strips 1 are secured in a correctly clamped state by the clamper 21. If they are not correctly secured, the clamper checking sensor 24 issues a command to restrain the brushing device 50 from operating.

The clamper solenoid valve 23 is a solenoid valve which provides ON-OFF control to determine whether or not the compressed air required as power should be supplied when the clamper 21 is to clamp or unclamp the two ski strips 1.

(3) The wax supplying device 30 is a device which serves to store the wax and to feed the stored wax to a wax spraying nozzle 53. The wax supplying device 30 is constituted by a wax tank 31 for storing the wax, a wax pump 32 for feeding the wax stored in the wax tank 31, a wax tube 33 through which the wax fed by the wax pump 32 is supplied to the brushing device 50, a flow control valve 34 (FIG. 4) for regulating the flow of the wax fed from the wax pump 32 to the brushing device 50, and a three-way solenoid valve 35 (FIG. 4) for mixing the wax passed through the flow control valve 34 (FIG. 4) and the compressed air from the compressor 42 and supplying the mixture to the brushing device 50.

In the present embodiment, the wax supplying device 30 is located on the left-hand side in the space of the interior of the body 11 for accommodating ski strips 1, as viewed from the same side as the swingable door 12. The wax pump 32 and the wax tank 31, the flow control valve 34, the three-way solenoid valve 35, and the wax tube 33 are located on that order from the bottom of the interior of the body 11.

Since the brushing device 50 which is supplied with the wax through the wax tube 33 is caused to move up and down in the interior of the body 11 by the movement device 60, the distance between the wax tank 31 and the brushing device 50 is not constant. Accordingly, the wax tube 33 is made from a spiral tube.

Although not shown, a level sensor is provided in the interior of the wax tank 31. If the amount of wax remaining becomes small, the level sensor serves to issue an alarm, restrain the brushing device 50 from operating, and so forth.

(4) The compressed-air supplying device 40 is a device which serves to generate compressed air and supply the compressed air. The compressed-air supplying device 40 is constituted by a blower 41 for supplying air, a compressor 42 for generating compressed air from the air supplied from the blower 41, a filter 44 (FIG. 4) for eliminating dirt, dust and so forth contained in the compressed air generated by the compressor 42, a regulator 45 (FIG. 4) for regulating the pressure of the compressed air passed through the filter 44 (FIG. 4), a compressed-air tube 43 through which the compressed air whose pressure has been regulated by the regulator 45 (FIG. 4) is fed to the brushing device 50, and a flow control valve 46 (FIG. 4) for regulating the flow of the compressed air.

In the present embodiment the compressed-air supplying device 40 is located on the right-hand side in the space of the interior of the body 11 for accommodating ski strips, as viewed from the same side as the swingable door 12. The blower 41, the compressor 42, the flow control valve 46 and the compressed-air tube 43 are located on that order from the bottom of the interior of the body 11.

Since the brushing device 50 which supplied with compressed air through the compressed-air tube 43 is caused to move up and down in the interior of the body 11 by the movement device 60, the distance between the compressor 42 and the brushing device 50 is not constant. Accordingly, the compressed-air tube 43 is made from a spiral tube.

(5) The brushing device 50 is a device which effects application of a wax coat and so forth while moving along the longitudinal axes of ski strips 1 by the driving of the movement device 60. The brushing device 50 is provided with a heater 54 (FIG. 4) for heating the compressed air supplied from the compressed-air supplying device 40 and converting it into hot air, a hot air nozzle 51 for blowing the hot air produced by the heater 54 (FIG. 4) to the sliding surfaces of the ski strips 1 so as to melt snow stuck to them or to dry wax which has just been coated, a roller brush 52 for removing dust from the sliding surfaces of the ski strips 1 in preparation for coating of a new wax or polishing the newly coated wax, the roller brash 52 being arranged to effect brushing the ski strips 1 along their longitudinal axes, and a wax spraying nozzle 53 for spraying the wax supplied from the wax tank 31 on to the sliding surfaces of the ski strips 1.

In the present embodiment, the brushing device 50 is constituted by an integral combination of the hot air nozzle 51, the roller brash 52 and the wax spraying nozzle 53 which are arranged in that order from the lower side. The brushing device 50 is located near the upper ends of the ski strips 1 which are accommodated in the body 11.

(6) The movement device 60 serves to cause the brushing device 50 to move along the longitudinal axes of the ski strips 1. The movement device 60 is constituted by a rail 61 serving to guide the movement of the brushing device 50, a reversible motor 62 serving as the power source required for the brushing device 50 to move back and forth along the rail 61, a wire 63 serving as a medium for transmitting the power of the reversible motor 62 to the brushing device 50, a tension pulley 64 for applying tension to the wire 63, and a direction checking sensor 65 serving to determine the turning point of the direction of rotation of the reversible motor 62.

The rail 61 is vertically disposed along the longitudinal axes of the ski strips 1.

The reversible motor 62 is disposed at the bottom of the body 11 on the lower left as viewed form the same side as the swingable door 12. The reversible motor 62 makes forward rotation and reverse rotation as well as pause in accordance with a command from either of the direction checking sensors 65.

The direction checking sensors 65 are disposed at two locations near the upper end and lower end of the rail 61.

(7) FIG. 4 shows that the wax coating apparatus 10 according to the present embodiment is constituted by two lines: one line (hereinafter referred to as the "first line") is arranged to operate by utilizing, as power, the compressed air supplied from the compressor 42 and another line (hereinafter referred to as the "second line") is arranged in association with the wax supplied from the wax tank 31.

The first line is constituted by the securing device 20, the door lock 70, a part of the brushing device 50 constituted by the heater 54 and the hot air nozzle 51, and the compressed-air supplying device 40 for supplying compressed air serving to operate these devices.

The second line is constituted by the wax supplying device 30, the three-way solenoid valve 35, and the wax spraying nozzle 53 which constitutes a part of the brushing device 50.

The operation of the wax coating apparatus 10 according to the present embodiment will be described below.

(1) A skier opens the swingable door 12, supports the lower ends (trailing ends) of his two ski strips 1 on the strip holder 22, and locates the approximately mid portions of the respective ski strips 1 on the clamper 21.

Subsequently, when hi closes the swingable door 12 and throws a predetermined coin into the coin slot (not shown), the sequence of operations of the wax coating apparatus 10 is initiated.

(2) The door-lock cylinder 71 (FIG. 4) locks the swingable door 12 by means of the compressed air supplied from the compressed-air supplying device 40.

At this time, if the door-lock checking sensor 72 (FIG. 4) detects the fact that the swingable door 12 is not perfectly locked, the door-lock checking sensor 72 issues a command to restrain the brushing device 50 from operating.

(3) The clamper 21 clamps and secures the two ski strips 1 by means of the compressed air supplied from the compressed-air supplying device 40.

At this time, if the clamper checking sensor 24 (FIG. 4) detects the fact that the ski strips 1 are not correctly clamped or secured, the clamper checking sensor 24 issues a command to restrain the brushing device 50 from operating.

(4) When both the locking of the swingable door 12 and the clamping and securing of the ski strips 1 are correctly effected, the direction checking sensor 65 which is disposed near the upper end of the rail 61 is switched off and, at the same time, the direction checking sensor 65 which is disposed near the lower end of the rail 61 is switched on.

Simultaneously, the reversible motor 62 initiates its forward running and thus the brushing device 50 is caused to move along the sliding surfaces of the ski strips 1 from the upper to lower ends thereof by the rotational torque of the reversible motor 62. During this movement, the brushing device 50 operates follows:

(a) The hot air nozzle 51 blows onto the sliding surfaces of the ski strips 1 the compressed air which has been supplied from the compressed-air supplying device 40 and heated to a high temperature by the heater 54 (FIG. 4). Thereby, snow stuck to the sliding surfaces of the ski strips 1 is melt and the sliding surfaces are dried.

(b) The roller brush 52 rolls along the longitudinal axes of the ski strips 1 to remove dust or the like from the sliding surfaces of the ski strips 1.

(c) The wax spraying nozzle 53 sprays the sliding surfaces of the ski strips 1 with the wax supplied from the wax supplying device 30.

(d) When the brushing device 50 reaches the direction checking sensor 65 located near the lower end of the rail 61, the relevant direction checking sensor 65 is switched off and, at the same time, the direction checking sensor 65 near the upper end of the rail 61 is switched on. Simultaneously, the reversible motor 62 stops the forward running and then initiates its reverse running.

(5) After reached the lower ends of the ski strips 1, the brushing device 50 is caused to move along the sliding surfaces of the ski strips 1 from the lower to upper ends thereof by the reverse rotational torque of the reversible motor 62. During this movement, the brushing device 50 operates as follows:

(a) The roller brush 52 rolls and polishes the wax which has already been coated onto the sliding surfaces of the ski strips. Since the roller brush 52 rolls along the longitudinal axes of the ski strips, the surface texture of the wax coated is shaped in the longitudinal direction.

(b) The hot air nozzle 51 blows hot air onto the wax and dries it.

(c) When the brushing device 50 reaches the direction checking sensor 65 near the upper end of the rail 61, the direction checking sensor 65 is switched off and, at the same time, the reversible motor 62 stops the reverse running.

Thus, the brushing device 50 completes applying a wax coat.

(6) The sequence of operations of the wax coating apparatus 10 is stopped when the direction checking sensor 65 near the upper end of the rail 61 is switched off and the motion of the reversible motor 62 is stopped.

More specifically, the compressed air supplied from the compressed-air supplying device 40 to the clamper 21 is controlled by the clamper solenoid valve 23 (FIG. 4), and thus the clamping of the ski strips 1 by the clamper 21 is released.

Simultaneously, the compressed air supplied from the compressed-air supplying device 40 to the door-lock air cylinder 71 (FIG. 4) is controlled by the door-lock solenoid valve 73 (FIG. 4), and thus the locking of the swingable door 21 by the door-lock air cylinder 71 (FIG. 4) is released.

(7) When the application of the wax coat is completed, the skier opens the swingable door 12, removes the ski strips 1 from the wax coating apparatus 10, and closes the swingable door 12.

In accordance with the present embodiment, wax coating which has heretofore been manually carried out is automated by providing the automatic wax coating apparatus 10 for use with skis. Accordingly, the following advantages are provided.

(1) The required manual operation consists merely of placing the ski strips 1 into and removing them from the wax coating apparatus according to the present embodiment. Accordingly, the number of manual operations is greatly reduced and, additionally, a wax coat of accurately controlled uniformity, thickness, and surface texture can be applied by automation.

(2) The adoption of the brushing device 50 enables a reduction in the working time required to apply a wax coat.

More specifically, the brushing device 50 is constructed as a device constituted by an integral combination of the following three functions: the hot air nozzle 51 for blowing hot air to melt the snow stuck to the sliding surfaces of the ski strips 1 or to dry the wax coated, the roller brush 52 for removing dust stuck to the sliding surfaces of the ski strips 1 and for polishing the wax coated so as to impart the desired surface texture to it, and the wax spraying nozzle 53 for spraying the wax. Accordingly, the efficiency of applying and drying the wax is improved. In particular, the step of melting and drying the snow stuck to the ski strips 1 and the step of drying the wax coated by hot air can be efficiently effected, thereby enabling a reduction in the required working time.

(3) Applying a coat of wax is enabled only if there is a space which can accommodate the wax coating apparatus 10. Accordingly, it is not necessary to provide any working space for a skier himself to apply the wax coat. That is, applying the wax coat can be performed even in a small place.

(4) In the present embodiment, the securing of two ski strips 1 and the locking of the swingable doors 12, followed by the application of the wax coat, are effected by the clamper 21 and the air cylinder 71, both of which obtain their power from compressed air. Accordingly, these steps can be effected more surely than they could manually.

In addition, the clamp sensor 24 and the lock sensor 72 are provided for detecting whether or not the ski strips 1 are correctly secured and whether the swingable door 12 is correctly locked, respectively, and the wax coating apparatus 10 does not operate if the securing of the ski strips 1 or the locking of the swingable door 12 is not correct. Accordingly; it is possible to provide a wax coating apparatus which is characterized by safe and sure operations in that, for example, the ejection of a wax from the wax coating apparatus 10 can be prevented.

(5) The wax coating apparatus 10 provided in the present embodiment further has the advantage that, since the wax coating apparatus 10 is provided with the front glass window 13, a skier can observe with ease the manner in which the brushing device 50 is applying a wax coat.

Some variations of the present embodiment will be explained below.

(1) In the wax coating apparatus 10 according to the present embodiment, the front glass window 13 is provided in the swingable door 12. However, the front glass window 13 may be omitted for the purpose of a reduction in cost.

(2) The securing device 20 or the door lock 70 in the present embodiment is not limited only to those shown in the above-described embodiment. For example, it may be constructed to operate manually for the purpose of a reduction in cost.

(3) In the above description of the present embodiment, after the swingable door 12 is closed, the clamper 21 clamps and secures ski strips 1. However, the clamper 21 may be arranged to clamp and secure ski strips 1, for example, before the swingable door 12 has been closed. If the clamper 21 is arranged to operate in that order, even if the clamping and securing of ski strips 1 by the clamper 21 is not correct, it is possible to immediately modify the operation of the clamper 21.

(4) In the above description of the present embodiment, the brushing device 50 is arranged to make one reciprocating motion along the rail 61 and the application of a wax coat by the spray nozzle 53 is completed in one step when the brushing device 50 is moving from the upper to the lower ends of the rail 61. However, the number of coating steps is not limited only to one.

For example, the application of a wax coat by the wax spraying nozzle 53 may be implemented further when the brushing device 50 is moving from the upper to lower ends of the rail 61. The brushing device 50 may also be arranged to reciprocate along the rail 61 by a plurality of times for the purpose of applying a wax coat.

(5) In the above description of the present embodiment, the swingable door 12 is closed and a predetermined coin is thrown into the coin slot (not shown) and thus the sequence of operations of the wax coating apparatus 10 is initiated. However, the arrangement of the present embodiment is not limited only to the above-described one.

For example, the swingable door 12 may be arranged to be locked when in no use and to be unlocked when a predetermined coin is thrown into the coin slot (not shown). Depending upon where to install the present embodiment, such a coin slot may be omitted, that is, the apparatus may be arranged so that it can be operated free of charge.

What it claimed is:

1. An automatic wax coating apparatus for use with skis comprising, a securing device for securing a ski strips, a wax supplying device, a brushing device and a movement device, said each device being provided in the interior of a box for accommodating said a ski strips, in which said brushing device comprises a hot air nozzle for blowing hot air onto said ski strips, a roller brush for brushing the sliding surfaces of said a ski strips, and a wax nozzle for spraying said sliding surface of said a ski strips with a wax supplied from said wax supplying device, whereby said brushing device can be moved along the longitudinal axes of said a ski strips by means of said movement device.

2. An automatic wax coating apparatus according to claim 1, further comprising a swingable door provided on the front of said box, and a door lock.

3. An automatic wax coating apparatus according to claim 1, in which said securing device comprises a clamper, a clamper checking sensor and a clamper solenoid valve.

4. An automatic wax coating apparatus according to claim 1, further comprising a compressed-air supplying device which has a blower, a compressor and a compressed-air tube, and generates the compressed air to supply for said brushing device, said clamper and said door lock.

5. An automatic wax coating apparatus according to claim 1, in which said wax supplying device comprises a wax tank, a wax pump, a wax tube, a flow control valve for controlling the wax-feeding from said wax pump, and a three-way solenoid valve for mixing the wax through said flow control valve and said compressed-air to supply for said brushing device.

6. An automatic wax coating apparatus according to claim 1, in which said movement device comprises a rail for guiding the movement of said brushing device and a reversible motor for moving said brushing device back and forth along said rail by the medium of a wire and a tension pulley.

7. An automatic wax coating apparatus according to claim 1, in which said brushing device is provided with a heater for heating said compressed air to get said hot air.

* * * * *